US005796422A

United States Patent [19]

Hanson et al.

[11] Patent Number: 5,796,422

[45] Date of Patent: Aug. 18, 1998

[54] DIRECT TONER PROJECTION PRINTING USING AN INTERMEDIATE TRANSFER MEDIUM

[75] Inventors: Gary Hanson, Meridian; C. S. Chan, Boise, both of Id.

[73] Assignee: Hewlett-Packard Company, Palo Alto, Calif.

[21] Appl. No.: 544,050

[22] Filed: Oct. 17, 1995

[51] Int. Cl.[6] ..... B41J 2/01; B41J 2/385

[52] U.S. Cl. ..... 347/103; 347/117

[58] Field of Search ..... 347/55, 103, 115, 347/117, 120, 140, 151; 399/297, 298, 300, 314, 231

[56] References Cited

U.S. PATENT DOCUMENTS 3,781,105 12/1973 Meagher ..... 399/314
4,733,255 3/1988 Rasbury ..... 347/55
4,739,348 4/1988 Ando et al. ..... 347/55
5,121,144 6/1992 Larson et al. ..... 347/55
5,305,026 4/1994 Kazuo et al. ..... 347/55
5,353,105 10/1994 Gundlach et al. ..... 347/103 X

*Primary Examiner*—David F. Yockey

[57] ABSTRACT

An electrostatic printing apparatus includes a rotating transfer drum having an outer transfer surface. A plurality of direct toner projection units are positioned adjacent the transfer surface of the rotating transfer drum to project toner patterns of different colors onto the transfer surface in response to modulated signals. After the patterns are applied to the drum, they are transferred to paper and fused. The drum is constructed of two components: a base layer or core which is conductive, and a surface layer which is chosen primarily for its surface properties. The surface layer is conductive enough to allow toner particles to dissipate their electrical charges before additional toner is applied by downstream toner projection units.

9 Claims, 5 Drawing Sheets

DIRECT TONER PROJECTION PRINTING USING AN INTERMEDIATE TRANSFER MEDIUM

FIELD OF THE INVENTION

This invention relates to direct toner projection printing.

BACKGROUND OF THE INVENTION

U.S. Pat. No. 3,689,935, entitled "Electrostatic Line Printer," describes a method of printing by projecting a toner pattern onto paper with a toner modulator. The toner modulator consists of a small aperture or nozzle leading from a toner supply reservoir. To project toner particles from the reservoir onto a sheet of paper, the paper is positioned over a backing electrode. An electric potential or voltage is applied between the toner supply reservoir and the backing electrode. The voltage charges toner particles within the reservoir and attracts them toward the backing electrode. However, the toner must pass through the toner modulator aperture before reaching the paper. To regulate the flow of toner to the paper, a modulated voltage is applied in the vicinity of the modulator aperture. Charging the aperture to one voltage allows the voltage differential between the toner reservoir and the backing electrode to attract toner through the aperture and onto the paper. Charging the aperture to a different voltage essentially negates the attractive forces and effectively blocks the toner modulator aperture. Thus, application of toner to paper can be controlled by modulating the voltage at the toner modulator aperture.

To print over the entire area of a paper sheet, a row of modulator apertures is formed by the toner modulator across the transverse width of a page, and the page is transported longitudinally beneath the apertures. The toner modulator apertures are individually controlled while the paper passes beneath them to apply a toner pattern to the paper. After passing by the toner modulator, the toner is fixed or fused by conventional means such as heat and/or pressure.

The system described above can theoretically be used for color printing by providing a plurality of different toner modulator units, each having toner corresponding to a different color. The units are spaced from each other along the longitudinal direction of paper movement to sequentially apply the toners corresponding to different colors. A fusing station, downstream of the toner modulator units, then fuses the toner to the paper.

One critical shortcoming of such a color printing system is that toner particles build up an electrostatic charge on the non-conductive paper surface and thereby create an electrostatic counter-field that deflects additional oncoming toner particles. For example, suppose that the backing electrode is fixed at a positive voltage, and that the toner reservoir and contained toner particles are charged to a negative voltage. As the paper passes beneath the first toner modulator unit, toner is applied to a particular point on the paper. The toner has a negative charge which is not dissipated by the non-conductive paper. As the point reaches the second toner modulator unit, this negative charge tends to reduce the apparent electrostatic voltage at the particular point and to somewhat deflect toner that is projected from the second toner modulator unit. The effect becomes worse at the third and fourth toner modulator units. This has the obvious effect of lowering print accuracy and can also introduce a hue shift. Furthermore, the negatively charged particles repel each other and can actually explode when the paper is removed from the backing electrode.

SUMMARY OF THE INVENTION

The invention described below overcomes previous shortcomings of direct toner projection printing by utilizing an intermediate transfer drum. Rather than projecting toner directly onto paper, the toner is projected onto the transfer drum. The drum has a surface capable of dissipating the electrostatic charge carried by a projected toner particle. From the transfer drum, the toner is transferred to a print media such as paper and then fused to the paper.

The transfer drum is constructed of a conductive base material with an overlying surface material. The surface material is chosen on the basis of both physical and electrical properties. Physically, the surface material is chosen to provide a desired degree of micro-conformance and good surface release properties. Electrically, the surface material is chosen so that it dissipates the charge of toner applied from a toner modulator before the toner from the next toner modulator is applied.

DESCRIPTION OF THF DRAWINGS

DETAILED DESCRIPTION OF THE INVENTION

Figure 1:
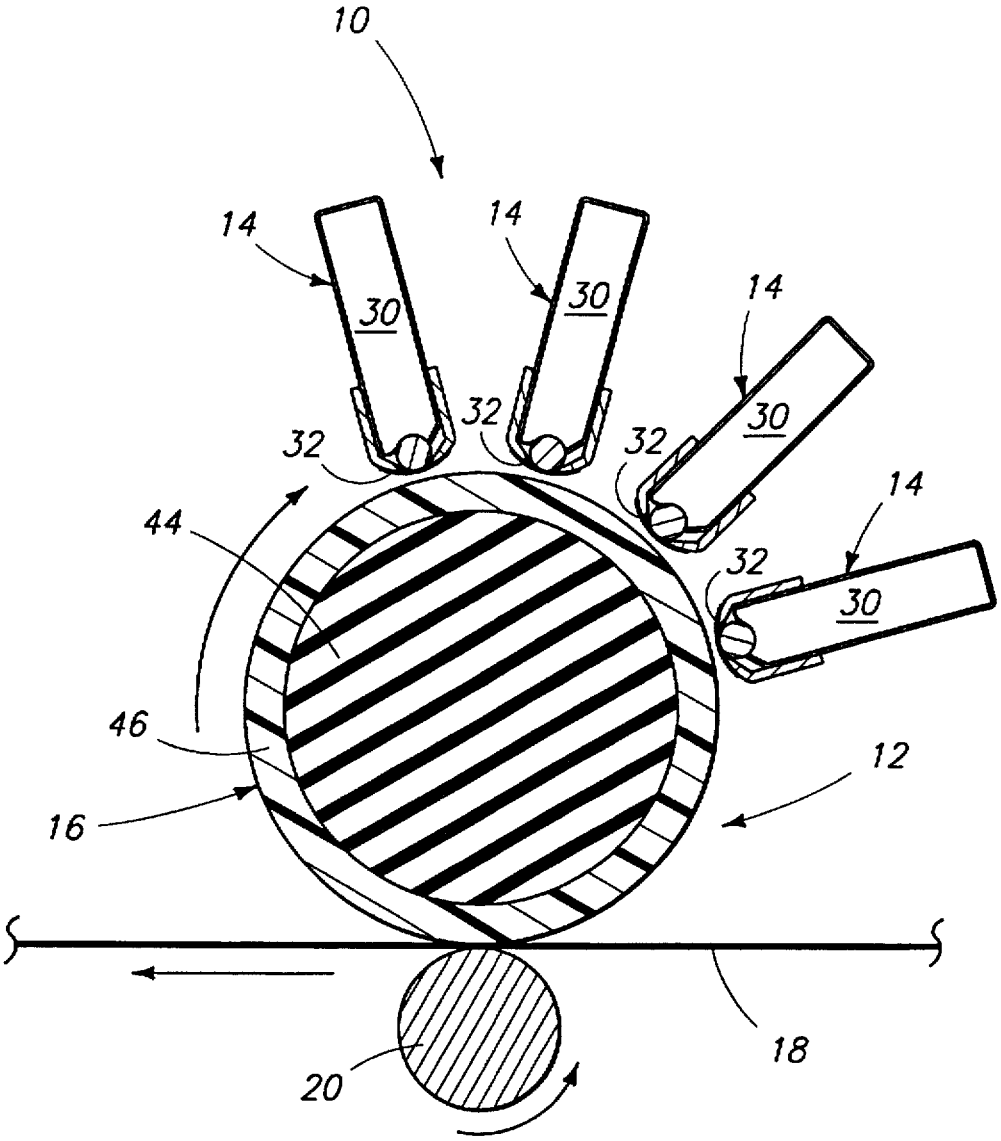
FIG. 1 is a cross-sectional view of an electrostatic printing apparatus in accordance with a preferred embodiment of the invention.
Figure 4:
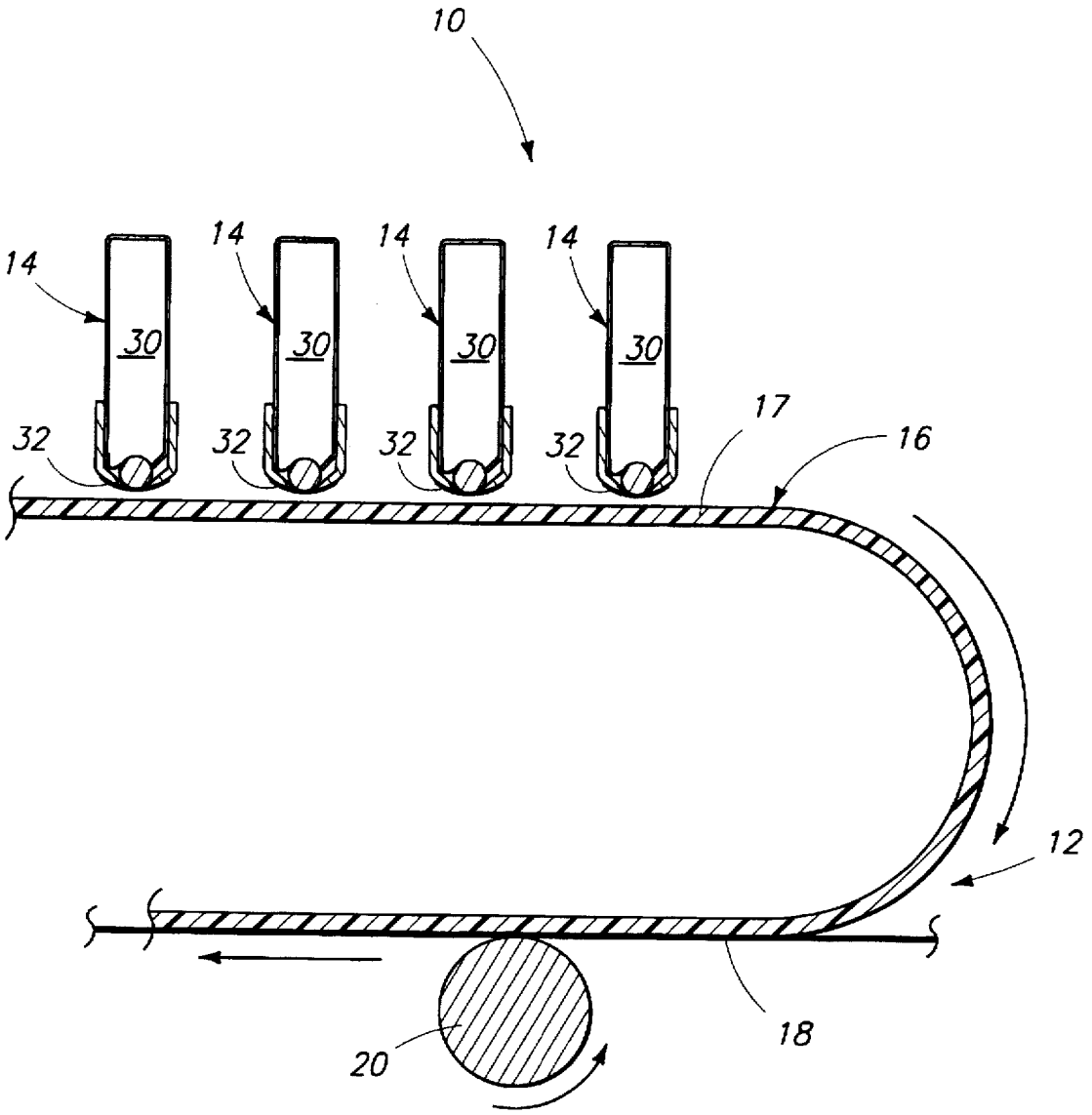
FIG. 4 is a cross-sectional view of an alternative embodiment of an electrostatic printing apparatus in accordance with a preferred embodiment of the invention.

FIG. 1 shows an electrostatic printing apparatus in accordance with a preferred embodiment of the invention, generally referenced by the numeral 10. Printing apparatus 10 comprises a rotating transfer medium or drum 12 and a plurality of toner projection units 14. Transfer drum 12 has an outer transfer surface 16 upon which toner is applied by toner projection units 14. An appropriate electric motor is connected to drum 12 for moving or rotating transfer surface 16 relative to the toner projection units. While the transfer medium in the preferred embodiment is a rotating cylindrical drum surface, a moving belt surface or other form of transfer medium might also be used. FIG. 4 shows an alternative embodiment having a moving belt surface 17.

In the preferred embodiment shown, the toner projection units 14 are arranged and spaced about the outer surface of the rotating transfer drum to sequentially project toner patterns corresponding to different colors, such as, for example, red, green, yellow, and black. Each projection unit 14 projects a pattern of toner onto the surface of drum 12. These patterns might overly each other on the drum. Thus, a particular point on outer transfer surface 16 might have toner applied from two or more of projection units 14.

Printing apparatus 12 further includes means for transferring the toner patterns from the transfer surface 16 to a sheet-like print medium 18, such as paper, and for fixing or fusing the toner patterns to the print medium. Such transfer and fusing can be accomplished by different techniques and mechanisms such as those used in conventional electrophotographic copying and printing. The embodiment shown includes a toner transfer and fixing mechanism 20 that both transfers and fuses using pressure and heat, comprising a hot fuser roll pressed against transfer surface 16. Print medium 18 is driven between drum 12 and fuser roll 20.

Figure 2:
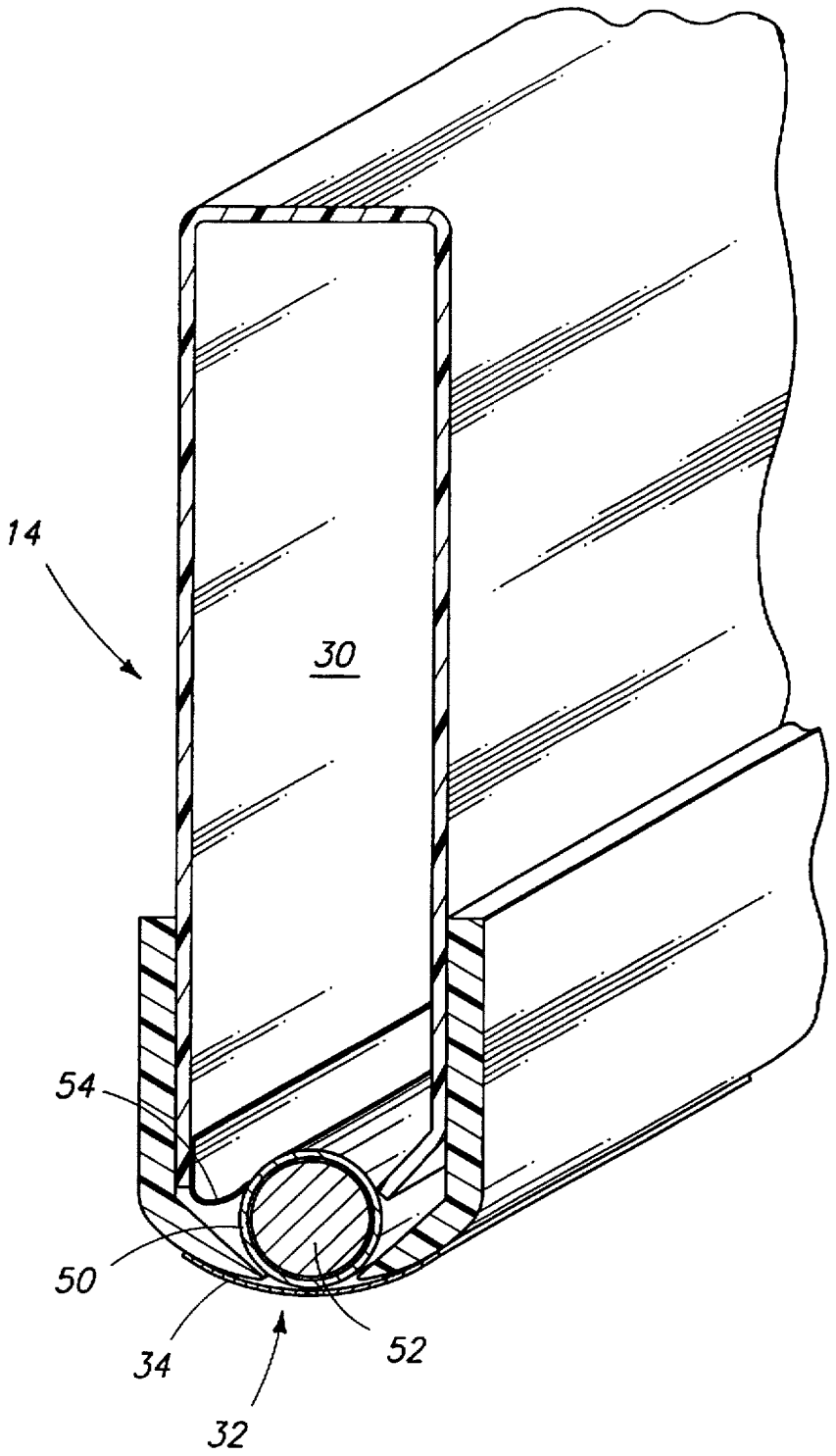
FIGS. 2 and 3 are upper-side and lower-side sectional perspective views of a toner projection unit in accordance with the preferred embodiment of the invention.
Figure 3:
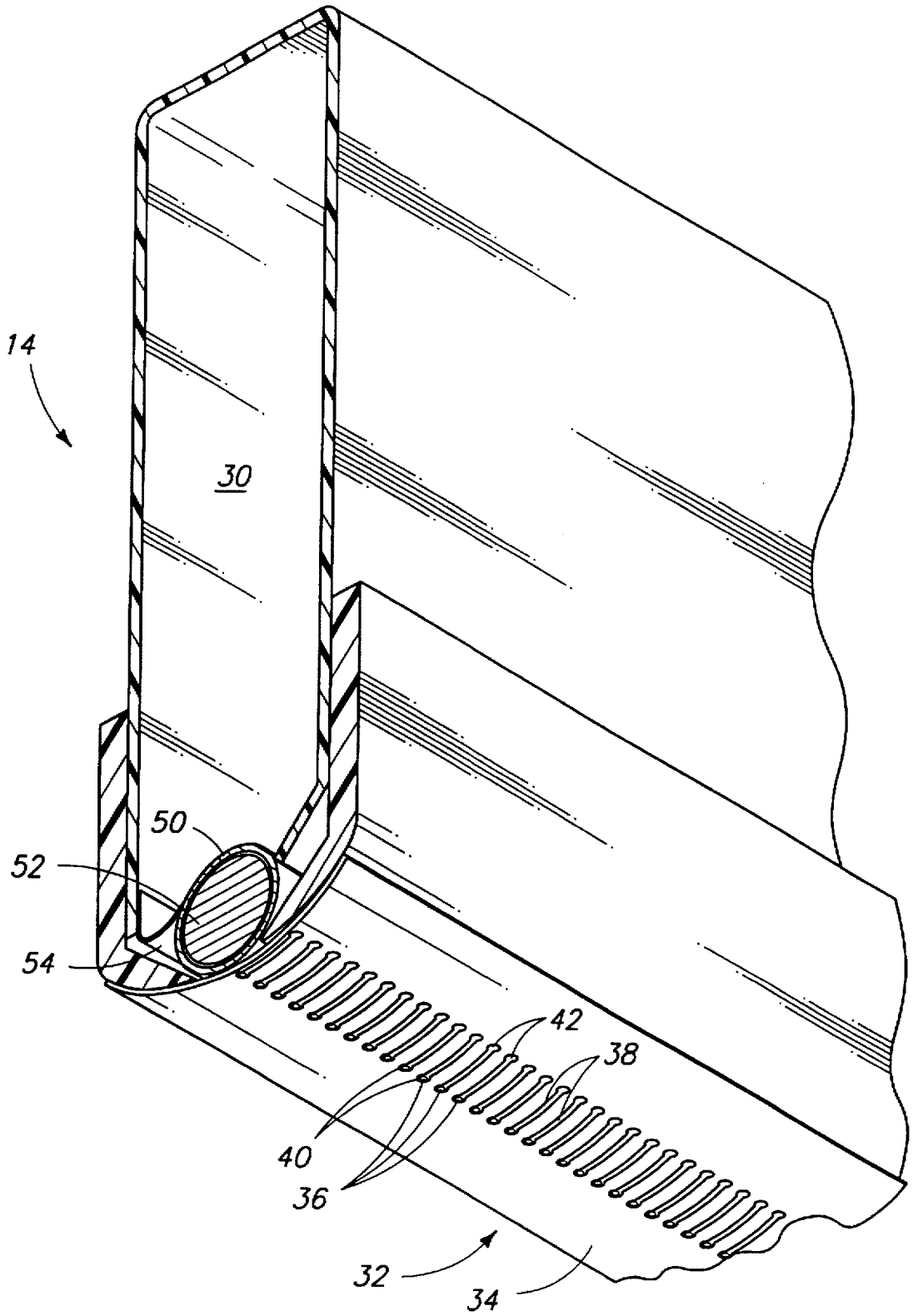

Toner projection units 14 are shown in more detail in FIGS. 2 and 3. They each comprise a toner supply reservoir 30 containing an electrically and magnetically charged powder toner (not shown). A variety of different toners are available and suitable for use in the embodiment of the invention described herein, including single and dual component toners. In the preferred embodiment a single component toner is used.

A toner modulator 32 is positioned between the toner supply reservoir and the transfer surface, adjacent to the transfer surface, to project a toner pattern onto the transfer surface. It comprises a thin plastic sheet or foil 34 having a plurality of toner modulator apertures 36 arranged as a linear or geometric array. In the preferred embodiment, the plastic foil is about 3–5 thousands of an inch thick. The upper side of foil 34 (not shown) is coated with a continuous conductor such as gold. The lower side has conductive gold traces 38 that form rings or gates 40 at and around the individual apertures. The traces extend to terminals 42 to which external connections can be made.

Apertures 36 are spaced as appropriate depending on the desired dot resolution. For instance, the apertures might be spaced at a pitch of 600 per inch. The preferred diameter of apertures 36 is 50–120 microns.

Each toner modulator aperture 36 defines a toner projection path from the toner supply reservoir to transfer surface 16. To project toner particles from supply reservoir 30 to transfer surface 16, the toner particles are charged by applying an electric potential to components within the supply reservoir. In the preferred embodiment, the applied electric potential is 125 volts AC, at a DC bias of 50 volts. The continuous conductor on the bottom side of foil 34 is held at ground potential. Transfer drum 12 is connected to an appropriate constant voltage source and thereby held at a DC potential of approximately 800 volts. This potential tends to attract toner from supply reservoir 30 toward transfer surface 16 of drum 12 through toner modulator apertures 36. To regulate toner flow, a voltage source is connected to modulate an electric potential at each toner modulator aperture to selectively block and unblock the toner projection path through the aperture and to thereby apply a toner pattern onto transfer surface 16. More specifically, the voltage at each gate is controlled by a modulated electrical control signal originating at external logic circuits. In response to the control signal, each gate 40 is modulated between a positive and a negative voltage. When a gate is at a positive voltage, the toner is attracted to and accelerates toward drum 12 through the toner modulator aperture. A negative voltage at a gate negates the attraction, effectively blocking the aperture and preventing toner from passing through the toner projection path defined by the aperture.

Referring again to FIG. 1, transfer drum 12 comprises a base layer or core 44 and an overlying transfer layer 46 which forms transfer surface 16. Core 44 is made from a base material which is chosen for both its electrical properties and its mechanical properties. Electrically, the material is conductive, having a resistivity of approximately 106 ohm-cm. Mechanically, the base material is hard although somewhat compliant, having a hardness of 40–45 Shore A. Silicone rubber is used in the preferred embodiment. Core 44 is the portion of drum 12 that is connected to the 800 volt electric potential mentioned above.

Figure 5:
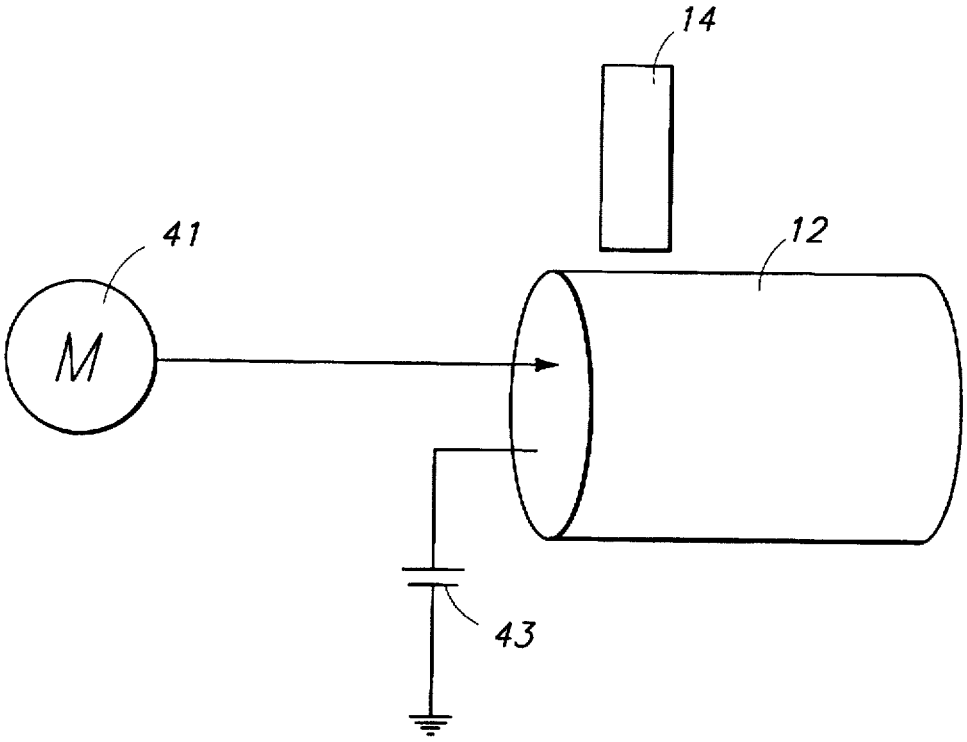
FIG. 5 is a schematic showing components of the electrostatic printing apparatus of FIG. 1.

FIG. 5 shows transfer drum 12, a toner projection unit 14, an electric motor 41 for rotating the transfer drum, and an electric potential 43 that forms means for applying an electrical potential through core 44.

Transfer layer 46 is formed by a surface material having electrical conductivity and toner release properties that facilitate toner transfer to and from the transfer surface. More specifically, a surface material is chosen that has good micro-conformance and desirable electrical properties. The preferred embodiment described herein uses a smooth surface finish of flurosilicone polymer (Dow Corning 940003), applied by spraying to a thickness of 3–6 thousandths of an inch. In some cases, it might be desirable to provide a very thin additional layer over this material to even further enhance the surface properties of transfer layer 46.

The desirable electrical property of the surface material is that its electrical relaxation time constant is of the same order of magnitude as the inter-unit transit time between one toner projection unit and the next. The inter-unit transit time is defined as the time required for a point on transfer surface 16 to travel from one toner projection unit to the next. The surface material of the transfer surface has a conductivity that allows the toner applied by a single one of the toner projection units to substantially dissipate its electrical charge during the inter-unit transit time.

FIGS. 3 and 4 show toner projection unit 14 in more detail than FIG. 1. Projection unit 14 has a toner delivery system, commonly referred to as a "magnetic brush," which sweeps toner particles over the upper surface of toner modulator 32. The magnetic brush comprises a rotating sleeve 50. Sleeve 50 is aluminum with a textured and hardened surface. It rotates within reservoir 30 so that toner rests upon the top surfaces of the sleeve as it rotates. It is furthermore positioned adjacent the array of toner modulator apertures 36 above foil 34. There is a spacing of about 7–10 thousandths of an inch between the sleeve and foil 34 at the point where the outer surface of sleeve 50 is directly opposite apertures 36. Sleeve 50 is connected to a voltage source of 125 volts AC, at a DC bias of about 50 volts.

Within sleeve 50 is a radially multi-polar cylindrical magnet 52. Magnet 52 is stationary within sleeve 50. The magnet has multiple north and south poles, arranged radially so that a particular point on the sleeve passes repeatedly from one pole to another.

As sleeve 50 rotates through the toner particles, the toner particles are attracted by stationary magnet 52 against the outer surface of sleeve 50. The particles form chains on the outer surface of sleeve 50 along magnetic field lines defined by magnet 52. Magnet 52 is arranged within sleeve 50 so that the field lines are radially outward from sleeve 50 at the point where sleeve 50 is closest to the apertures of foil 34. This results in toner particle chains that extend outward from sleeve 50 toward toner modulator apertures 36. The outermost toner particles in the chain are most susceptible to the attractive electrostatic forces created by the electric potential of transfer drum 12. It is these particles that are projected through the toner modulator apertures, depending on the voltages at gates 40. A blade or wiper 54 is positioned to regulate the amount of toner carried by sleeve 50.

The magnetic brush itself is similar or identical to magnetic brushes used in laser printers and electrophotographic copiers. In those devices, the brush is positioned adjacent a photoconductive drum. Electrophotographic technology and related magnetic brushes are described in "The Electrical Engineering Handbook," 1993, published by CRC Press, Inc, of Boca Raton, Fla., at pages 1959–1964. Other types of toner delivery systems, such as non-magnetic semiconductor toner developers, might also be used in place of the toner delivery system specifically described herein.

Although the invention has been described in terms of its mechanical and electrical characteristic, the invention also encompasses a method of electrostatic printing. The method comprises a step of positioning a toner modulator aperture between a toner supply reservoir and a transfer medium so that the toner modulator aperture defines a toner projection path from the toner supply reservoir to the transfer medium. The method further comprises applying an electric potential between the toner supply reservoir and the transfer medium to attract toner to the transfer medium through the toner modulator aperture, while moving the transfer medium relative to the toner modulator aperture.

A further step in accordance with the invention includes modulating an electric potential at the toner modulator aperture to selectively block and unblock the toner projection path and to thereby apply a toner pattern onto the transfer medium.

Additional preferred steps include forming the transfer medium with a conductive base material in combination with an overlying surface material having electrical conductivity and toner release properties that facilitate toner transfer to and from the transfer medium. More specifically, the surface material has an electrical conductivity that allows the toner applied by one of the toner modulator apertures to substantially dissipate its electrical charge during the inter-unit transit time.

Further steps include transferring the toner pattern from the transfer medium to a print medium, and fixing or fusing the toner pattern on the print medium.

The invention overcomes previous difficulties in multicolor printing using direct toner projection. The use of an intermediate transfer surface allows a printer designer to have nearly complete control over the mechanical and electrical properties of the surface upon which toner is projected, while adding very little complexity to the resulting apparatus. Using a two-layer construction for the transfer medium provides further advantages. The base layer can be selected to provide necessary rigidity and conductance, while the overlying surface layer can be chosen primarily based upon its surface properties. Providing a charge-dissipating transfer surface allows deposited toner to dissipate its electrical charge before additional toner is applied, thereby increasing the accuracy and overall quality of multicolor printing. Allowing toner to dissipate its charge before it is applied to paper also reduces the self-repulsion of the toner particles, thereby reducing or eliminating the tendency for toner piles to explode after they are removed from a backing electrode.

In compliance with the statute, the invention has been described in language more or less specific as to structural and methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A method of electrostatic printing comprising the following steps:

forming a transfer medium with a conductive base material in combination with an overlying surface material, the overlying surface material having electrical conductivity and toner release properties that facilitate toner transfer to and from the transfer medium;

positioning a plurality of toner modulators, the toner modulator having apertures that define toner projection paths from toner supply reservoirs to the transfer medium; spacing the toner modulator apertures from each other to result in an inter-unit transit time, the inter-unit transit time being the time required for a point on the transfer medium to travel from one of the toner modulator apertures to a next one of the toner modulator apertures;

applying an electric potential between the toner supply reservoirs and the transfer medium through the conductive base material to attract toner to the transfer medium through the toner modulator apertures;

moving the transfer medium and the toner modulator apertures relative to each other;

modulating an electric potential at the toner modulator apertures to selectively block and unblock the toner projection paths and to thereby apply toner patterns corresponding to different colors onto the transfer medium, wherein toner applied to the transfer medium has an electrical charge;

transferring the toner pattern from the transfer medium to a print medium;

fixing the toner pattern on the print medium;

wherein the overlying surface material has an electrical relaxation time constant that is within an order of magnitude of the inter-unit transit time.

2. An electrostatic printing apparatus comprising:

a plurality of toner supply reservoirs having toner, the toner capable of having an electrical charge;

a transfer medium having a conductive base material and an overlying transfer surface formed by a surface material;

means for applying an electric potential through the conductive base material to attract toner from the toner supply reservoirs to the transfer surface;

a plurality of toner modulators positioned between the toner supply reservoirs and the transfer surface, the toner modulators having apertures that define toner projection paths from the toner supply reservoirs to the transfer surface to apply toner patterns corresponding to different colors onto the transfer surface;

means for moving the transfer surface and the toner modulator relative to each other; the toner modulators being spaced from each other to result in an inter-unit transit time, the inter-unit transit time being the time required for a point on the transfer medium to travel from one of the toner modulators to a next one of the toner modulators;

a toner transfer mechanism that transfers the toner pattern from the transfer surface to a print medium;

a toner fixing mechanism that fixes the toner pattern to the print medium;

wherein the surface material of the transfer medium has an electrical relaxation time constant that is within an order of magnitude of the inter-unit transit time.

3. An electrostatic printing apparatus as recited in claim 2 wherein the transfer surface is a rotating drum surface.

4. An electrostatic printing apparatus as recited in claim 2 wherein the transfer surface is a moving belt surface.

5. An electrostatic printing apparatus as recited in claim 2, the surface material of the transfer medium being relatively less conductive than the base material.

6. An electrostatic printing apparatus as recited in claim 2, the surface material of the transfer medium having a thickness in a range of three to six thousandths of an inch.

7. An electrostatic printing apparatus comprising:

a rotating transfer drum having an outer transfer surface and a conductive core, an electric potential being applied through the conductive core to attract toner to the transfer surface;

means for rotating the rotating transfer drum;

a plurality of toner projection units having toner modulators positioned adjacent the transfer surface of the rotating transfer drum to project toner patterns corresponding to different colors onto the transfer surface;

the toner projection units being spaced from each other to result in an inter-unit transit time, the inter-unit transit time being the time required for a point on the transfer surface of the rotating transfer drum to travel from one of the toner projection units to a next of the toner projection units;

a toner transfer mechanism that transfers the toner pattern from the transfer surface to a print medium;

a toner fixing mechanism that fixes the toner pattern to the print medium;

further comprising an overlying surface material having an electrical relaxation time constant that is within an order of magnitude of the inter-unit transit time.

8. An electrostatic printing apparatus as recited in claim 7, further comprising an overlying surface material forming the transfer surface, the surface material being relatively less conductive than the conductive core.

9. An electrostatic printing apparatus as recited in claim 7, further comprising an overlying surface material forming the transfer surface, the surface material having electrical conductivity and toner release properties that facilitate toner transfer to and from the transfer surface and having a thickness in a range of three to six thousandths of an inch.

* * * * *